US012385118B2

(12) United States Patent
Kato et al.

(10) Patent No.: US 12,385,118 B2
(45) Date of Patent: Aug. 12, 2025

(54) DUPLEX STAINLESS SEAMLESS STEEL PIPE AND METHOD FOR PRODUCING DUPLEX STAINLESS SEAMLESS STEEL PIPE

(71) Applicant: NIPPON STEEL CORPORATION, Tokyo (JP)

(72) Inventors: Kosei Kato, Tokyo (JP); Yusaku Tomio, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 919 days.

(21) Appl. No.: 17/429,432

(22) PCT Filed: Apr. 23, 2020

(86) PCT No.: PCT/JP2020/017511
§ 371 (c)(1),
(2) Date: Aug. 9, 2021

(87) PCT Pub. No.: WO2020/218426
PCT Pub. Date: Oct. 29, 2020

(65) Prior Publication Data

US 2022/0127707 A1 Apr. 28, 2022

(30) Foreign Application Priority Data

Apr. 24, 2019 (JP) ..... 2019-083337

(51) Int. Cl.
*C22C 38/58* (2006.01)
*C21D 8/10* (2006.01)
(Continued)

(52) U.S. Cl.
CPC ..... *C22C 38/58* (2013.01); *C21D 8/105* (2013.01); *C22C 38/001* (2013.01); *C22C 38/02* (2013.01);
(Continued)

(58) Field of Classification Search
CPC ..... C22C 38/58; C22C 38/001; C22C 38/02; C22C 38/42; C22C 38/04; C21D 8/105;
(Continued)

(56) References Cited

U.S. PATENT DOCUMENTS

2013/0312880 A1* 11/2013 Motoya ..... C22C 1/02 420/61
2013/0315776 A1* 11/2013 Yamada ..... C22C 38/06 420/45

FOREIGN PATENT DOCUMENTS

JP 03291358 A 12/1991
JP 2016003377 A 1/2016
(Continued)

*Primary Examiner* — Jonathan Johnson
*Assistant Examiner* — Maxwell Xavier Duffy
(74) *Attorney, Agent, or Firm* — Greer, Burns & Crain, Ltd.

(57) ABSTRACT

The duplex stainless seamless steel pipe according to the present disclosure has the chemical composition described in the description and a microstructure composed of 30.0 to 70.0% of ferrite, and austenite. In an observation field of view region of a square shape with a side of 1.0 mm, the region including a center portion of wall thickness and including an L direction and a T direction. A number of intersections NT, which is the number of intersections between the line segments T1 to T4 which is four line segments extending in the T direction and a ferrite interface, is 40.0 or more. A number of intersections NL, which is the number of intersections between the line segments L1 to L4 which is four line segments extending in the L direction and the ferrite interface, and the number of intersections NT satisfy Formula (1).

$$NT/NL \geq 2.0 \quad (1)$$

8 Claims, 2 Drawing Sheets

(51) Int. Cl.

| | |
|---|---|
| ***C22C 38/00*** | (2006.01) |
| ***C22C 38/02*** | (2006.01) |
| ***C22C 38/06*** | (2006.01) |
| ***C22C 38/42*** | (2006.01) |
| ***C22C 38/44*** | (2006.01) |

(52) U.S. Cl.
CPC ..... *C22C 38/06* (2013.01); *C22C 38/42* (2013.01); *C22C 38/44* (2013.01); *C21D 2211/001* (2013.01)

(58) Field of Classification Search
CPC ..... C21D 2211/001; C21D 1/26; C21D 2211/005; C21D 6/004; C21D 9/08
See application file for complete search history.

(56) References Cited

FOREIGN PATENT DOCUMENTS

| | | | | |
|---|---|---|---|---|
| JP | 2016084522 | A | * | 5/2016 |
| JP | 2016172891 | A | * | 9/2016 |
| WO | 2012111536 | A1 | | 8/2012 |

* cited by examiner

DUPLEX STAINLESS SEAMLESS STEEL PIPE AND METHOD FOR PRODUCING DUPLEX STAINLESS SEAMLESS STEEL PIPE

This is a National Phase Application filed under 35 U.S.C. § 371, of International Application No. PCT/JP2020/017511, filed Apr. 23, 2020, the contents of which are incorporated by reference.

TECHNICAL FIELD

The present disclosure relates to a duplex stainless steel material and a method for producing the same and more specifically, to a duplex stainless seamless steel pipe and a method for producing the same.

BACKGROUND ART

There are cases in which oil wells or gas wells (hereinafter, oil wells and gas wells are collectively referred to simply as "oil wells") become a corrosive environment containing a corrosive gas. Here, the corrosive gas means carbon dioxide gas and/or hydrogen sulfide gas. That is, steel materials for use in oil wells are required to have excellent corrosion resistance in a corrosive environment.

So far, as a method for improving the corrosion resistance of the steel material, there is known a method of increasing the content of chromium (Cr) and forming a passivation film mainly composed of Cr oxide on the surface of the steel material. Therefore, in an environment where excellent corrosion resistance is required, a duplex stainless steel material having an increased Cr content is used in some cases. Duplex stainless steel materials are known to exhibit excellent corrosion resistance, especially in seawater.

Also, in recent years, oil wells have been developed in environments harsher than those of before. An environment harsher than those of before is, for example, the Polar Regions. Steel materials used for oil wells in cold regions such as the Polar Regions are required to have not only excellent corrosion resistance but also excellent low-temperature toughness.

Japanese Patent Application Publication No. 03-291358 (Patent Literature 1), Japanese Patent Application Publication No. 10-60597 (Patent Literature 2), and International Application Publication No. WO2012/111536 (Patent Literature 3), and Japanese Patent Application Publication No. 2016-3377 (Patent Literature 4) each propose a technique to improve low-temperature toughness of a duplex stainless steel material.

The duplex stainless steel material disclosed in Patent Literature 1 contains, in weight %, Cr: 20 to 30%, Ni: 3 to 12%, and Mo: 0.2 to 5.0%, further including sol. Al: 0.01 to 0.05%, O: less than 0.0020%, and S: 0.0003% or less. Patent Literature 1 discloses that this duplex stainless steel material is excellent in toughness and hot workability.

The duplex stainless steel material disclosed in Patent Literature 2 contains ferrite in an amount of 60 to 90% in area ratio, in which a Ni balance value (=Ni+0.5Mn+30(C+N)−1.1(Cr+1.5Si+Mo+0.5Nb)+8.2) is −15 to −10, and Formula (Al content×N content 0.0023×Ni balance value+0.357) is satisfied. Patent Literature 2 discloses that this duplex stainless steel material has high strength and excellent toughness.

The duplex stainless steel material disclosed in Patent Literature 3 has a chemical composition consisting of, in mass %, C: 0.030% or less, Si: 0.20 to 1.00%, Mn: 8.00% or less, P: 0.040% or less, S: 0.0100% or less, Cu: more than 2.00 to 4.00% or less, Ni: 4.00 to 8.00%, Cr: 20.0 to 30.0%, Mo: 0.50 to less than 2.00%, N: 0.100 to 0.350%, and Al: 0.040% or less, with the balance being Fe and impurities, and a microstructure having a ferrite ratio of 30 to 70%, in which the hardness of ferrite is 300 $Hv_{10gf}$ or more. Patent Literature 3 discloses that this duplex stainless steel material has high strength and high toughness.

The duplex stainless steel pipe disclosed in Patent Literature 4 has a chemical composition consisting of, in mass %, C: 0.03% or less, Si: 0.2 to 1%, Mn: 0.5 to 2.0%, P: 0.040% or less, S: 0.010% or less, Al: 0.040% or less, Ni: 4 to less than 6%, Cr: 20 to less than 25%, Mo: 2.0 to 4.0%, N: 0.1 to 0.35%, O: 0.003% or less, V: 0.05 to 1.5%, Ca: 0.0005 to 0.02%, and B: 0.0005 to 0.02%, with the balance being Fe and impurities, and a metal microstructure composed of a duplex microstructure of a ferrite phase and an austenite phase, in which there is no precipitation of a sigma phase, a proportion of the ferrite phase in the metal microstructure is 50% or less in area ratio, and the number of oxides having a particle size of 30 μm or more existing in a visual field of 300 $mm^2$ is 15 or less. Patent Literature 4 discloses that this duplex stainless steel pipe is excellent in strength, pitting resistance, and low-temperature toughness.

CITATION LIST

Patent Literature

Patent Literature 1: Japanese Patent Application Publication No. 03-291358

Patent Literature 2: Japanese Patent Application Publication No. 10-60597

Patent Literature 3: International Application Publication No. WO2012/111536

Patent Literature 4: Japanese Patent Application Publication No. 2016-3377

SUMMARY OF INVENTION

Technical Problem

As oil-well environments grow harsher in recent years, there is a growing demand for a duplex stainless seamless steel pipe having higher low-temperature toughness than before. As described above, Patent Literatures 1 to 4 disclose duplex stainless steel materials having excellent low-temperature toughness. However, a duplex stainless seamless steel pipe having excellent low-temperature toughness may be obtained by a technique other than those disclosed in Patent Literatures 1 to 4.

It is an object of the present disclosure to provide a duplex stainless seamless steel pipe having excellent low-temperature toughness and a method for producing the duplex stainless seamless steel pipe.

Solution to Problem

A duplex stainless seamless steel pipe according to the present disclosure has:

a chemical composition consisting of, in mass %,

C: 0.030% or less,

Si: 0.20 to 1.00%,

Mn: 0.50 to 7.00%,

P: 0.040% or less,

S: 0.0100% or less,

Cu: 1.80 to 4.00%,

Cr: 20.00 to 28.00%,
Ni: 4.00 to 9.00%,
Mo: 0.50 to 2.00%,
Al: 0.100% or less,
N: 0.150 to 0.350%,
V: 0 to 1.50%,
Nb: 0 to 0.100%,
Ta: 0 to 0.100%,
Ti: 0 to 0.100%,
Zr: 0 to 0.100%,
Hf: 0 to 0.100%,
Ca: 0 to 0.0200%,
Mg: 0 to 0.0200%,
B: 0 to 0.0200%, and
rare earth metal: 0 to 0.200%, with the balance being Fe and impurities, and a microstructure consisting of 30.0 to 70.0% of ferrite in volume ratio and austenite as the balance, wherein when a pipe axis direction of the duplex stainless seamless steel pipe is defined as an L direction and a pipe radius direction of the duplex stainless seamless steel pipe is defined as a T direction, in a square observation field of view region which includes a center portion of wall thickness of the duplex stainless seamless steel pipe, and whose side extending in the L direction is 1.0 mm long and whose side extending in the T direction is 1.0 mm long, four line segments, which extend in the T direction, which are arranged at equal intervals in the L direction of the observation field of view region, and which divide the observation field of view region into five equal parts in the L direction, are defined as T1 to T4, four line segments, which extend in the L direction, which are arranged at equal intervals in the T direction of the observation field of view region, and which divide the observation field of view region into five equal parts in the T direction, are defined as L1 to L4, and an interface between the ferrite and the austenite in the observation field of view region is defined as a ferrite interface, a number of intersections NT, which is a number of intersections between the line segments T1 to T4 and the ferrite interface, is 40.0 or more, and a number of intersections NL, which is a number of intersections between the line segments L1 to L4 and the ferrite interface, and the number of intersections NT satisfy Formula (1).

$$NT/NL \geq 2.0 \quad (1)$$

A method for producing a duplex stainless seamless steel pipe according to the present disclosure includes:

a starting material preparation step for preparing a starting material having the above-described chemical composition, a heating step for heating the starting material after the starting material preparation step at a heating temperature $T_A$° C. of 1000 to 1280° C.

a piercing-rolling step for piercing-rolling the starting material after the heating step at an area reduction ratio $R_A$% satisfying Formula (A) to produce a hollow shell, an elongating-rolling step for elongating and rolling the hollow shell after the piercing-rolling step, and a solution heat treatment step for holding the hollow shell after the elongating-rolling step at 950 to 1080° C. for 5 to 180 minutes:

$$R_A \geq -0.000200 \times T_A^2 + 0.513 \times T_A - 297 \quad (A)$$

where, $R_A$ in Formula (A) is defined by Formula (B).

$$R_A = \{1 - (\text{cross-sectional area perpendicular to pipe axis direction of the hollow shell after piercing-rolling/cross-sectional area perpendicular to axial direction of the starting material before piercing-rolling})\} \times 100 \quad (B)$$

Advantageous Effects of Invention

A duplex stainless seamless steel pipe according to the present disclosure has excellent low-temperature toughness. The method for producing a duplex stainless seamless steel pipe according to the present disclosure can produce the duplex stainless seamless steel pipe described above.

DESCRIPTION OF EMBODIMENT

Figure 1:
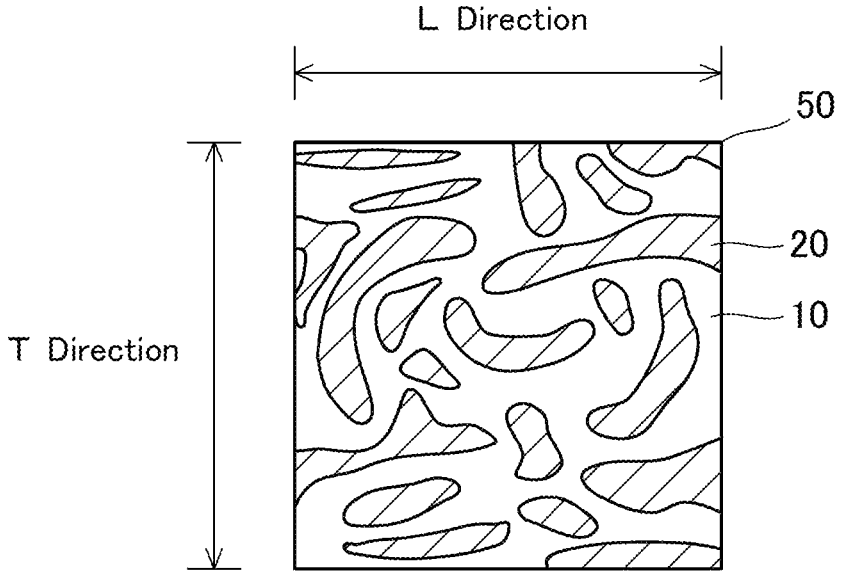
FIG. 1 is a schematic diagram of a microstructure in a cross section which is located at a center portion of wall thickness of a duplex stainless seamless steel pipe and which includes a pipe axis direction (L direction) and a pipe radius direction (T direction) of the duplex stainless seamless steel pipe, the duplex stainless seamless steel pipe having the same chemical composition as that of the duplex stainless seamless steel pipe of the present embodiment, but having a different microstructure.

The present inventors have examined an approach for improving low-temperature toughness of a duplex stainless seamless steel pipe. First, the present inventors have considered that a duplex stainless seamless steel pipe having a chemical composition consisting of: in mass %, C: 0.030% or less, Si: 0.20 to 1.00%, Mn: 0.50 to 7.00%, P: 0.040% or less, S: 0.0100% or less, Cu: 1.80 to 4.00%, Cr: 20.00 to 28.00%, Ni: 4.00 to 9.00%, Mo: 0.50 to 2.00%, Al: 0.100% or less, N: 0.150 to 0.350%. V: 0 to 1.50%, Nb: 0 to 0.100%, Ta: 0 to 0.100%, Ti: 0 to 0.100%, Zr: 0 to 0.100%, Hf: 0 to 0.100%, Ca: 0 to 0.0200%, Mg: 0 to 0.0200%, B: 0 to 0.0200%, and rare earth metal: 0 to 0.200%, with the balance being Fe and impurities can possibly achieve excellent low-temperature toughness.

Accordingly, the present inventors investigated and examined an approach for improving low-temperature toughness of a duplex stainless seamless steel pipe having the above-described chemical composition. Specifically, the present inventors focused on the microstructure of the duplex stainless seamless steel pipe having the above-described chemical composition. First, the microstructure of the duplex stainless seamless steel pipe having the above-described chemical composition includes ferrite and austenite.

Here, in a microstructure of a duplex stainless seamless steel pipe, ferrite has higher hardness than austenite. That is, ferrite has lower toughness than austenite. Therefore, if a minute crack occurs in the duplex stainless seamless steel pipe at a low temperature, the crack may propagate in the ferrite. If the crack propagates through the ferrite, brittle fracture occurs in the duplex stainless seamless steel pipe. That is, the present inventors have considered that in order to improve the low-temperature toughness of the above-described duplex stainless seamless steel pipe, it is effective to make crack propagation in ferrite difficult.

Therefore, the present inventors first investigated and examined the relationship between the volume ratios of ferrite and austenite and the low-temperature toughness. As a result, it was found that the low-temperature toughness of the duplex stainless seamless steel pipe can be improved by appropriately controlling the volume ratios of ferrite and austenite.

If the volume ratio of ferrite is too high, cracks will easily propagate through ferrite. As a result, the low-temperature toughness of duplex stainless seamless steel pipes deteriorates. On the other hand, if the volume ratio of austenite is too high, that is, if the volume ratio of ferrite is too low, other characteristics (for example, strength, corrosion resistance, etc.) required for a duplex stainless seamless steel pipe may not be obtained. Therefore, the duplex stainless seamless steel pipe according to the present embodiment has a microstructure in which the volume ratio of ferrite is 30.0 to 70.0%.

On the other hand, even in a duplex stainless seamless steel pipe which has the above-described chemical composition and in which the volume ratio of ferrite is 30.0 to 70.0%, there was a case in which excellent low-temperature toughness was not obtained. Therefore, the present inventors then focused on the distribution state of ferrite and austenite. As described above, if a crack occurs in a duplex stainless seamless steel pipe, it may propagate in ferrite. Therefore, even when the volume ratio of ferrite is 70.0% or less, if coarse ferrite is present, minute cracks may propagate in the coarse ferrite. As a result, the duplex stainless seamless steel pipe may not be able to achieve excellent low-temperature toughness.

By the way, a duplex stainless seamless steel pipe, which is assumed to be used for oil well applications, is subjected to piercing-rolling and elongating-rolling in the production process. Due to the piercing-rolling, machining strain in the vicinity of the inner surface of the duplex stainless seamless steel pipe tends to increase. Further, due to the elongating-rolling, machining strain in the vicinity of the inner surface and the vicinity of the outer surface of the duplex stainless seamless steel pipe tends to increase. As a result, in the duplex stainless seamless steel pipe, the machining strain tends to be lowered in the center portion of wall thickness. In this way, it is considered that coarse ferrite and coarse austenite are likely to be present in the center portion of wall thickness of the duplex stainless seamless steel pipe, which is assumed to be used for oil well applications.

Therefore, the present inventors observed the microstructure of the center portion of wall thickness of the duplex stainless seamless steel pipe, and investigated and examined the relationship between the distribution state of ferrite and austenite and the low-temperature toughness in detail. First, the present inventors observed a cross section including a pipe axis direction and a pipe radius direction in a center portion of wall thickness of a duplex stainless seamless steel pipe which has the above-described chemical composition, and in which the volume ratio of ferrite is 30.0 to 70.0%, thereby observing the distribution state of ferrite and austenite.

Figure 2:
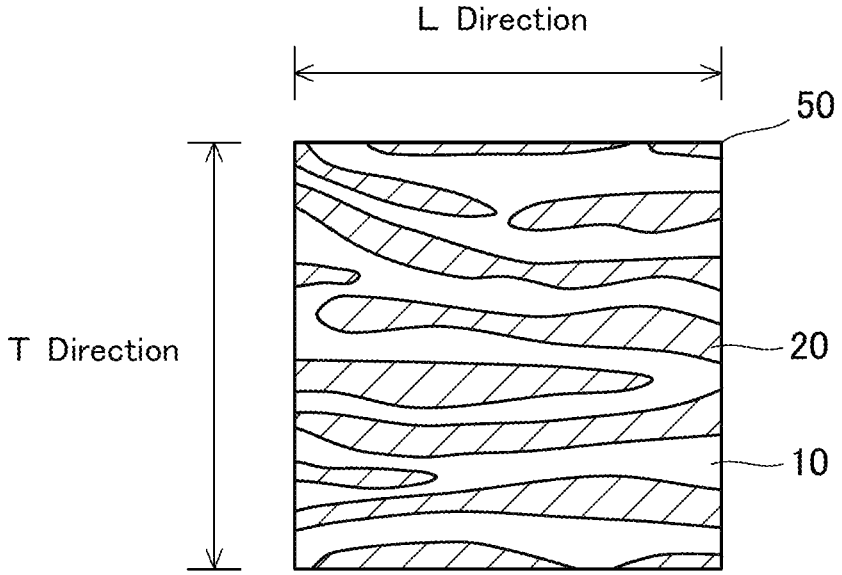
FIG. 2 is a schematic diagram of the microstructure in a cross section which is located at the center portion of wall thickness of the duplex stainless seamless steel pipe of the present embodiment, and which includes the L direction and the T direction.

FIGS. 1 and 2 are schematic diagrams showing an example of a microstructure in a cross section including a pipe axis direction and a pipe radius direction in a center portion of wall thickness of a duplex stainless seamless steel pipe having the above-described chemical composition. The horizontal direction in the observation field of view region 50 of FIG. 1 corresponds to the pipe axis direction, and the vertical direction in the observation field of view region 50 of FIG. 1 corresponds to the pipe radius direction. Similarly, the horizontal direction in the observation field of view region 50 of FIG. 2 corresponds to the pipe axis direction, and the vertical direction in the observation field of view region 50 of FIG. 2 corresponds to the pipe radius direction. Note that in the present description, the pipe axis direction of the duplex stainless seamless steel pipe is also referred to as an "L direction." Further, the pipe radius direction of the duplex stainless seamless steel pipe is also referred to as a "T direction." In each of FIGS. 1 and 2, the observation field of view region 50 shown in the schematic diagram is 1.0 mm long in the L direction and 1.0 mm long in the T direction.

In FIGS. 1 and 2, a white region 10 is ferrite. A hatched region 20 is austenite. The volume ratio of ferrite 10 and the volume ratio of austenite 20 in the observation field of view region 50 of FIG. 1 are not so different from the volume ratio of the ferrite 10 and the volume ratio of the austenite 20 in the observation field of view region 50 of FIG. 2. However, the distribution state of the ferrite 10 and the austenite 20 in the observation field of view region 50 of FIG. 1 is significantly different from the distribution state of the ferrite 10 and the austenite 20 in the observation field of view region 50 of FIG. 2.

Specifically, in the microstructure shown in FIG. 1, the ferrite 10 and the austenite 20 each extend in random directions, forming a non-layered structure. On the other hand, in the microstructure shown in FIG. 2, both the ferrite 10 and the austenite 20 extend in the L direction, and the ferrite 10 and the austenite 20 are laminated in the T direction. That is, the microstructure shown in FIG. 2 is a layered structure of the ferrite 10 and the austenite 20.

As described above, in a duplex stainless seamless steel pipe which has the above-described chemical composition and in which the volume ratio of ferrite is 30.0 to 70.0%, the distribution state of ferrite and austenite in the microstructure may be significantly different even if volume ratios of ferrite and austenite are at the same level. Accordingly, the present inventors have investigated in more detail the relationship between the distribution state of ferrite and austenite in the microstructure and the low-temperature toughness.

First, the present inventors have defined a layer index LI as an index of the distribution state of ferrite and austenite in the microstructure by the following Formula (1).

$$\text{(Layer index LI)} = \text{(Number of intersections } NT \text{ in } T \text{ direction)} / \text{(Number of intersections } NL \text{ in } L \text{ direction)} \quad (1)$$

Figure 3:
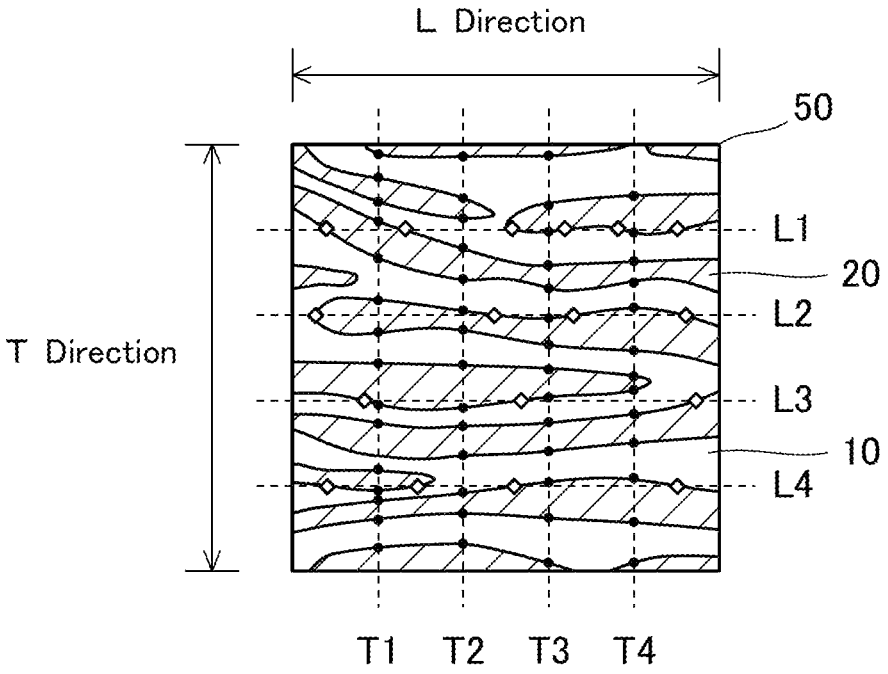
FIG. 3 is a schematic diagram to illustrate a calculation method of a layer index (LI) in the present embodiment.

The layer index LI will be described Referring to the drawings. FIG. 3 is a schematic diagram for explaining a method of calculating the layer index LI in the present embodiment. The observation field of view region 50 in FIG. 3 is a square region whose side extending in the L direction is 1.0 mm long and whose side extending in the T direction is 1.0 mm long in a cross section including the L direction and the T direction at a center portion of wall thickness of the duplex stainless seamless steel pipe. In FIG. 3, in the observation field of view region 50, the ferrite 10 and the austenite 20 are included. Here, an interface between the ferrite 10 and the austenite 20 is defined as a "ferrite interface." Here, since the ferrite 10 and the austenite 20 have different contrast in microscopic observation, those skilled in the art can easily identify them.

Line segments T1 to T4 in FIG. 3 are line segments extending in the T direction, arranged at equal intervals in the L direction of the observation field of view region 50, and dividing the observation field of view region 50 into five equal parts in the L direction. The number of intersections (marked with "●" in FIG. 3) between the line segments T1 to T4 and the ferrite interface in the observation field of view region 50 is defined as a number of intersections NT (pieces). The line segments L1 to L4 in FIG. 3 are line segments extending in the L direction, arranged at equal intervals in the T direction of the observation field of view region 50, and dividing the observation field of view region 50 into five equal parts in the T direction. The number of intersections (marked with "◇" in FIG. 3) between the line segments L1 to L4 and the ferrite interface in the observation field of view region 50 is defined as a number of intersections NL (pieces).

The layer index LI (=NT/NL) can be determined by using the determined number of intersections NT (pieces) in the T direction, the number of intersections NL (pieces) in the L direction, and Formula (1). Subsequently, the present inventors have conducted detailed investigation and examination on a relationship between the layer index LI and low-temperature toughness in a duplex stainless seamless steel pipe which has the above-described chemical composition and in which the volume ratio of ferrite is 30.0 to 70.0%.

Table 1 shows excerption from Table 3, which includes the steel of Test Numbers 1, 16, 17, and 19, the volume ratio of ferrite, the number of intersections NT in the T direction, the number of intersections NL in the L direction, the layer index LI, and the absorbed energy E and the energy transition temperature vTE, which are indicators of low-temperature toughness, in Examples to be described later.

TABLE 1

| Test Number | Steel | Ferrite volume ratio (%) | NT (pieces) | NL (pieces) | LI | E (J) | vTE (° C.) |
|---|---|---|---|---|---|---|---|
| 1 | A | 52.0 | 43.8 | 12.9 | 3.4 | 254 | −40.8 |
| 16 | A | 54.3 | 46.3 | 21.7 | 2.1 | 140 | −19.6 |
| 17 | A | 50.2 | 40.5 | 21.1 | 1.9 | 98 | −13.4 |
| 19 | A | 57.5 | 33.5 | 19.1 | 1.8 | 94 | −8.1 |

Referring to Table 1, Test Numbers 1, 16, 17, and 19 all used the same steel A. That is, the chemical compositions of Test Numbers 1, 16, 17, and 19 were the same. Further, Referring to Table 1, the volume ratios of ferrite of Test Numbers 1, 16, 17, and 19 were all 30.0 to 70.0%, and were about the same. On the other hand, referring to Table 1, Test Number 19 had a smaller number of intersections NT in the T direction than Test Numbers 1, 16, and 17. That is, it is considered that a large amount of coarse ferrite was produced. As a result, the absorbed energy E was less than 120 J, and the energy transition temperature vTE was more than −18.0° C. That is, Test Number 19, which had a smaller number of intersections in the T direction, did not exhibit excellent low-temperature toughness.

Furthermore, referring to Table 1, the numbers of the intersections NT in the T direction of Test Numbers 1, 16 and 17 were all 40.0 or more, and were about the same. That is, in each of Test Numbers 1, 16 and 17, it is considered that ferrite and austenite formed a fine microstructure. On the other hand, referring to Table 1. Test Number 17 had a smaller layer index LI than those of Test Numbers 1 and 16. That is, in Test Number 17, it is considered that the non-layered structure represented by FIG. 1 was formed in the microstructure. As a result, the absorbed energy E was less than 120 J, and the energy transition temperature vTE was more than −18.0° C. That is, Test No. 17, which had a smaller layer index LI, did not exhibit excellent low-temperature toughness.

In short, the present inventors have found that in a duplex stainless seamless steel pipe which has the above-described chemical composition and in which the volume ratio of ferrite is 30.0 to 70.0%, low-temperature toughness can be remarkably enhanced not only by refining ferrite, but also by forming a layered structure represented by FIG. 2.

Therefore, the duplex stainless seamless steel pipe according to the present embodiment has the above-described chemical composition, and a microstructure which includes 30.0 to 70.0% of ferrite in volume ratio and austenite, and in which the number of intersections NT in the T direction is 40.0 or more, and further the layer index LI is 2.0 or more in the microstructure at the center portion of wall thickness of the duplex stainless seamless steel pipe. As a result, the duplex stainless seamless steel pipe according to the present embodiment has excellent low-temperature toughness.

The gist of the duplex stainless seamless steel pipe according to the present embodiment which has been completed based on the above findings is as follows.

[1]

A duplex stainless seamless steel pipe, comprising:

a chemical composition consisting of, in mass %,

C: 0.030% or less,

Si: 0.20 to 1.00%,

Mn: 0.50 to 7.00%,

P: 0.040% or less,

S: 0.0100% or less,

Cu: 1.80 to 4.00%,

Cr: 20.00 to 28.00%,

Ni: 4.00 to 9.00%,

Mo: 0.50 to 2.00%,

Al: 0.100% or less,

N: 0.150 to 0.350%,

V: 0 to 1.500%,

Nb: 0 to 0.100%,

Ta: 0 to 0.100%,

Ti: 0 to 0.100%,

Zr: 0 to 0.100%,

Hf: 0 to 0.100%,

Ca: 0 to 0.0200%,

Mg: 0 to 0.0200%,

B: 0 to 0.0200%, and rare earth metal: 0 to 0.200%, with the balance being Fe and impurities, and a microstructure consisting of 30.0 to 70.0% of ferrite in volume ratio and austenite as the balance, wherein when a pipe axis direction of the duplex stainless seamless steel pipe is defined as an L direction and a pipe radius direction of the duplex stainless seamless steel pipe is defined as a T direction, in a square observation field of view region which includes a center portion of wall thickness of the duplex stainless seamless steel pipe, and whose side extending in the L direction is 1.0 mm long and whose side extending in the T direction is 1.0 mm long, four line segments, which extend in the T direction, which are arranged at equal intervals in the L direction of the observation field of view region, and which divide the observation field of view region into five equal parts in the L direction, are defined as T1 to T4, four line segments, which extend in the L direction, which are arranged at equal intervals in the T direction of the observation field of view region, and which divide the observation field of view region into five equal parts in the T direction, are defined as L1 to L4, and an interface between the ferrite and the austenite in the observation field of view region is defined as a ferrite interface, a number of intersections NT, which is a number of intersections between the line segments T1 to T4 and the ferrite interface, is 40.0 or more, and a number of intersections NL, which is a number of intersections between the line segments LI to L4 and the ferrite interface, and the number of intersections NT satisfy Formula (1).

$$NT/NL \geq 2.0 \quad (1)$$

[2]

The duplex stainless seamless steel pipe according to [1], wherein the chemical composition contains one or more types of element selected from the group consisting of:

V: 0.01 to 1.50%,

Nb: 0.001 to 0.100%,

Ta: 0.001 to 0.100%,

Ti: 0.001 to 0.100%,

Zr: 0.001 to 0.100%, and

Hf: 0.001 to 0.100%.

[3]

The duplex stainless seamless steel pipe according to [1] or [2], wherein the chemical composition contains one or more types of element selected from the group consisting of:

Ca: 0.0005 to 0.0200%,

Mg: 0.0005 to 0.0200%,

B: 0.0005 to 0.0200%, and rare earth metal: 0.005 to 0.200%.

[4]

A method for producing a duplex stainless seamless steel pipe, including:

a starting material preparation step for preparing a starting material having the chemical composition according to any one of [1] to [3], a heating step for heating the starting material after the starting material preparation step at a heating temperature TA° C. of 1000 to 1280° C., a piercing-rolling step for piercing-rolling the starting material after the heating step at an area reduction ratio $R_A$ % satisfying Formula (A) to produce a hollow shell, an elongating-rolling step for elongating and rolling the hollow shell after the piercing-rolling step, and a solution heat treatment step for holding the hollow shell after the elongating-rolling step at 950 to 1080° C. for 5 to 180 minutes:

$$R_A \geq -0.000200 \times T_A^2 + 0.513 \times T_A - 297 \quad (A)$$

where, $R_A$ in Formula (A) is defined by Formula (B).

$$R_A = \{1 - (\text{cross-sectional area perpendicular to pipe axis direction of the hollow shell after piercing-rolling}/\text{cross-sectional area perpendicular to axial direction of the starting material before piercing-rolling})\} \times 100 \quad (B)$$

Hereinafter, the duplex stainless seamless steel pipe according to the present embodiment will be described in detail. Note that "%" concerning an element means mass % unless otherwise specified.

[Chemical Composition]

The chemical composition of a duplex stainless seamless steel pipe according to the present embodiment contains the following elements.

C: 0.030% or Less

Carbon (C) is unavoidably contained. That is, the lower limit of the C content is more than 0%. C forms Cr carbides at crystal grain boundaries and increases corrosion sensitivity at the grain boundaries. As a result, the corrosion resistance of the steel material deteriorates even if the contents of other elements are within the range of the present embodiment. Therefore, the C content is 0.030% or less. An upper limit of the C content is preferably 0.028%, and more preferably 0.025%. The C content is preferably as low as possible. However, an extreme reduction of the C content will significantly increase the production cost. Therefore, when industrial manufacturing is taken into consideration, a lower limit of the C content is preferably 0.001%, and more preferably 0.005%.

Si: 0.20 to 1.00%

Silicon (Si) deoxidizes steel. If the Si content is too low, the aforementioned effect cannot be sufficiently obtained even if the contents of other elements is within the range of the present embodiment. On the other hand, if the Si content is too high, the low-temperature toughness and hot workability of the steel material will deteriorate even if the contents of other elements are within the range of the present embodiment. Therefore, the Si content is 0.20 to 1.00%. A lower limit of the Si content is preferably 0.25%, and more preferably 0.30%. An upper limit of the Si content is preferably 0.85%, and more preferably 0.75%.

Mn: 0.50 to 7.00%

Manganese (Mn) deoxidizes steel and desulfurizes steel. Mn further enhances the hot workability of the steel material. If the Mn content is too low, the aforementioned effect cannot be sufficiently obtained even if the contents of other elements are within the range of the present embodiment. On the other hand, if the Mn content is too high, Mn segregates at grain boundaries together with impurities such as P and S. In this case, even if the contents of other elements are within the range of the present embodiment, the corrosion resistance of the steel material in a high-temperature environment will deteriorate. Therefore, the Mn content is 0.50 to 7.00%. A lower limit of the Mn content is preferably 0.75%, and more preferably 1.00%. An upper limit of the Mn content is preferably 6.50%, and more preferably 6.20%.

P: 0.040% or Less

Phosphorus (P) is an impurity. That is, the lower limit of the P content is more than 0%. P segregates at grain boundaries and deteriorates low-temperature toughness of the steel material. Therefore, the P content is 0.040% or less. An upper limit of the P content is preferably 0.035%, and more preferably 0.030%. The P content is preferably as low as possible. However, an extreme reduction of the P content will significantly increase the production cost. Therefore, when industrial manufacturing is taken into consideration, a lower limit of the P content is preferably 0.001%, and more preferably 0.003%.

S: 0.0100% or Less

Sulfur (S) is an impurity. That is, the lower limit of the S content is more than 0%. S segregates at grain boundaries and deteriorates the low-temperature toughness and hot workability of the steel material. Therefore, the S content is 0.0100% or less. An upper limit of the S content is preferably 0.0085%, and more preferably 0.0065%. The S content is preferably as low as possible. However, an extreme reduction of the S content will significantly increase the production cost. Therefore, when industrial manufacturing is taken into consideration, a lower limit of the S content is preferably 0.0001%, and more preferably 0.0003%.

Cu: 1.80 to 4.00%

Copper (Cu) increases the strength of the steel material by precipitation strengthening. Cu further enhances the corrosion resistance of the steel material in a high-temperature environment. If the Cu content is too low, the aforementioned effect cannot be sufficiently obtained even if the contents of other elements are within the range of the present embodiment. On the other hand, if the Cu content is too high, hot workability of the steel material deteriorates even if the contents of other elements are within the range of the present embodiment. Therefore, the Cu content is 1.80 to 4.00%. A lower limit of the Cu content is preferably 1.90%, more preferably 2.00%, further preferably 2.20%, and further preferably 2.50%. An upper limit of the Cu content is preferably 3.90%, more preferably 3.75%, and further preferably 3.50%.

Cr: 20.00 to 28.00%

Chromium (Cr) enhances the corrosion resistance of the steel material in a high-temperature environment. Specifically, Cr forms a passivation film as an oxide on the surface of the steel material. As a result, the corrosion resistance of the steel material is improved. Cr is an element that further increases the volume ratio of ferrite in a steel material. By increasing the volume ratio of ferrite, the corrosion resistance of the steel material is stabilized. If the Cr content is too low, the aforementioned effects cannot be sufficiently obtained even if the contents of other elements are within the range of the present embodiment. On the other hand, if the Cr content is too high, the hot workability of the steel material deteriorates even if the contents of other elements are within the range of the present embodiment. Therefore, the Cr content is 20.00 to 28.00%. A lower limit of the Cr content is preferably 20.50%, more preferably 21.00%, and further preferably 21.50%. An upper limit of the Cr content is preferably 27.50%, more preferably 27.00%, and further preferably 26.50%.

Ni: 4.00 to 9.00%

Nickel (Ni) is an element that stabilizes austenite in a steel material. That is, Ni is an element necessary for obtaining a stable duplex microstructure of ferrite and austenite. Ni also enhances the corrosion resistance of the steel material in a high-temperature environment. If the Ni content is too low, the aforementioned effect cannot be sufficiently obtained even if the contents of other elements are within the range of the present embodiment. On the other hand, if the Ni content is too high, the volume ratio of austenite becomes too high and the strength of the steel material decreases even if the content of other elements is within the range of the present embodiment. Therefore, the Ni content is 4.00 to 9.00%. A lower limit of the Ni content is preferably 4.20%, more preferably 4.30%, further preferably 4.40%, and further preferably 4.50%. An upper limit of the Ni content is preferably 8.50%, more preferably 8.00%, further preferably 7.50%, further preferably 7.00%, and further preferably 6.75%.

Mo: 0.50 to 2.00%

Molybdenum (Mo) enhances the corrosion resistance of the steel material in a high-temperature environment. If the Mo content is too low, the aforementioned effect cannot be sufficiently obtained even if the contents of other elements are within the range of the present embodiment. On the other hand, if the Mo content is too high, hot workability of the steel material deteriorates even if the contents of other elements are within the range of the present embodiment. Therefore, the Mo content is 0.50 to 2.00%. A lower limit of the Mo content is preferably 0.60%, more preferably 0.70%, and further preferably 0.80%. An upper limit of the Mo content is preferably 1.85%, and more preferably 1.50%.

Al: 0.100% or Less

Aluminum (Al) is unavoidably contained. That is, a lower limit of the Al content is more than 0%. Al deoxidizes the steel. On the other hand, if the Al content is too high, coarse oxide-based inclusions are formed and low-temperature toughness of the steel material deteriorates even if the contents of other elements are within the range of the present embodiment. Therefore, the Al content is 0.100% or less. A lower limit of the Al content is preferably 0.001%, more preferably 0.005%, and further preferably 0.010%. An upper limit of the Al content is preferably 0.080%, and more preferably 0.050%. Note that the Al content referred to in the present description means the content of "acid-soluble Al," that is, sol. Al.

N: 0.150 to 0.350%

Nitrogen (N) is an element that stabilizes austenite in the steel material. That is, N is an element necessary for obtaining a stable duplex microstructure of ferrite and austenite. N further enhances the corrosion resistance of the steel material. If the N content is too low, the aforementioned effect cannot be sufficiently obtained even if the contents of other elements are within the range of the present embodiment. On the other hand, if the N content is too high, low-temperature toughness and hot workability of the steel material will deteriorate even if the contents of other elements are within the range of the present embodiment. Therefore, the N content is 0.150 to 0.350%. A lower limit of the N content is preferably 0.170%, more preferably 0.180%, and further preferably 0.200%. An upper limit of the N content is preferably 0.340%, and more preferably 0.330%.

The balance of the chemical composition of the dual stainless seamless steel pipe according to the present embodiment is Fe and impurities. Here, impurities in a chemical composition means those which are mixed from ores and scraps as the raw material or from the production environment when industrially producing the duplex stainless seamless steel pipe, and which are permitted within a range not adversely affecting the duplex stainless seamless steel pipe of the present embodiment.

[Optional Elements]

The chemical composition of the duplex stainless seamless steel pipe described above may further contain one or more types of element selected from the group consisting of V, Nb, Ta, Ti, Zr, and Hf in place of part of Fe. All of these elements are optional elements and increase the strength of the steel material.

V: 0 to 1.50%

Vanadium (V) is an optional element and does not have to be contained. That is, the V content may be 0%. When contained, V forms a carbonitride and increases the strength of the steel material. If even a small amount of V is contained, the aforementioned effect can be obtained to some extent. However, if the V content is too high, the strength of the steel material becomes too high and the low-temperature toughness of the steel material deteriorates even if the contents of other elements are within the range of the present embodiment. Therefore, the V content is 0 to 1.50%. A lower limit of the V content is preferably more than 0%, more preferably 0.01%, further preferably 0.03%, and further preferably 0.05%. An upper limit of the V content is preferably 1.20%, and more preferably 1.00%.

Nb: 0 to 0.100%

Niobium (Nb) is an optional element and does not have to be contained. That is, the Nb content may be 0%. When contained, Nb forms a carbonitride and increases the strength of the steel material. If even a small amount of Nb is contained, the aforementioned effect can be obtained to some extent. However, if the Nb content is too high, the strength of the steel material becomes too high and the low-temperature toughness of the steel material deteriorates even if the contents of other elements are within the range of the present embodiment. Therefore, the Nb content is 0 to 0.100%. A lower limit of the Nb content is preferably more than 0%, more preferably 0.001%, further preferably 0.002%, and further preferably 0.003%. An upper limit of the Nb content is preferably 0.080%, and more preferably 0.070%.

Ta: 0 to 0.100%

Tantalum (Ta) is an optional element and does not have to be contained. That is, the Ta content may be 0%. When contained, Ta forms a carbonitride and increases the strength of the steel material. If even a small amount of Ta is contained, the aforementioned effect can be obtained to some extent. However, if the Ta content is too high, the strength of the steel material becomes too high and the low-temperature toughness of the steel material deteriorates even if the contents of other elements are within the range of the present embodiment. Therefore, the Ta content is 0 to 0.100%. A lower limit of the Ta content is preferably more than 0%, more preferably 0.001%, further preferably 0.002%, and further preferably 0.003%. An upper limit of the Ta content is preferably 0.080%, and more preferably 0.070%.

Ti: 0 to 0.100%

Titanium (Ti) is an optional element and does not have to be contained. That is, the Ti content may be 0%. When contained, Ti forms a carbonitride and increases the strength of the steel material. If even a small amount of Ti is contained, the aforementioned effect can be obtained to some extent. However, if the Ti content is too high, the strength of the steel material becomes too high and the low-temperature toughness of the steel material deteriorates even if the contents of other elements are within the range of the present embodiment. Therefore, the Ti content is 0 to 0.100%. A lower limit of the Ti content is preferably more than 0%, more preferably 0.001%, further preferably 0.002%, and further preferably 0.003%. An upper limit of the Ti content is preferably 0.080%, and more preferably 0.070%.

Zr: 0 to 0.100%

Zirconium (Zr) is an optional element and does not have to be contained. That is, the Zr content may be 0%. When contained, Zr forms a carbonitride and increases the strength of the steel material. If even a small amount of Zr is contained, the aforementioned effect can be obtained to some extent. However, if the Zr content is too high, the strength of the steel material becomes too high and the low-temperature toughness of the steel material deteriorates even if the contents of other elements are within the range of the present embodiment. Therefore, the Zr content is 0 to 0.100%. A lower limit of the Zr content is preferably more than 0%, more preferably 0.001%, further preferably 0.002%, and further preferably 0.003%. An upper limit of the Zr content is preferably 0.080%, and more preferably 0.070%.

Hf: 0 to 0.100%

Hafnium (Hf) is an optional element and does not have to be contained. That is, the Hf content may be 0%. When contained, Hf forms a carbonitride and increases the strength of the steel material. If even a small amount of Hf is contained, the aforementioned effect can be obtained to some extent. However, if the Hf content is too high, the strength of the steel material becomes too high and the low-temperature toughness of the steel material deteriorates even if the contents of other elements are within the range of the present embodiment. Therefore, the Hf content is 0 to 0.100%. A lower limit of the Hf content is preferably more than 0%, more preferably 0.001%, further preferably 0.002%, and further preferably 0.003%. An upper limit of the Hf content is preferably 0.080%, and more preferably 0.070%.

The chemical composition of the duplex stainless seamless steel pipe described above may further contain one or more types of element selected from the group consisting of Ca, Mg, B, and rare earth metal, in place of part of Fe. All of these elements are optional elements and enhance the hot workability of the steel material.

Ca: 0 to 0.0200%

Calcium (Ca) is an optional element and does not have to be contained. That is, the Ca content may be 0%. When contained, Ca immobilizes S in the steel material as sulfide to make it harmless, and thereby improves the hot workability of the steel material. If even a small amount of Ca is contained, the aforementioned effect can be obtained to some extent. However, if the Ca content is too high, even if the contents of other elements are within the range of the present embodiment, the oxide in the steel material becomes coarse and the low-temperature toughness of the steel material deteriorates. Therefore, the Ca content is 0 to 0.0200%. A lower limit of the Ca content is preferably more than 0%, more preferably 0.0005%, and further preferably 0.0010%. An upper limit of the Ca content is preferably 0.0180%, and more preferably 0.0150%.

Mg: 0 to 0.0200%

Magnesium (Mg) is an optional element and does not have to be contained. That is, the Mg content may be 0%. When contained, Mg immobilizes S in the steel material as sulfide to make it harmless, and thus improves the hot workability of the steel material. If even a small amount of Mg is contained, the aforementioned effect can be obtained to some extent. However, if the Mg content is too high, even if the contents of other elements are within the range of the present embodiment, the oxide in the steel material becomes coarse and the low-temperature toughness of the steel material deteriorates. Therefore, the Mg content is 0 to 0.0200%. A lower limit of the Mg content is preferably more than 0%, more preferably 0.0005%, further preferably 0.0010%, further preferably 0.0020%, and further preferably 0.0030%. An upper limit of the Mg content is preferably 0.0180%, and more preferably 0.0150%.

B: 0 to 0.0200%

Boron (B) is an optional element and does not have to be contained. That is, the B content may be 0%. When contained, B suppresses segregation of S at grain boundaries in the steel material and enhances the hot-workability of the steel material. If even a small amount of B is contained, the aforementioned effect can be obtained to some extent. However, if the B content is too high, boron nitride (BN) is produced, thereby deteriorating the low-temperature toughness of the steel material even if the contents of other elements are within the range of the present embodiment. Therefore, the B content is 0 to 0.0200%. A lower limit of the B content is preferably more than 0%, more preferably 0.0005%, further preferably 0.0010%, further preferably 0.0020%, and further preferably 0.0030%. An upper limit of the B content is preferably 0.0180%, and more preferably 0.0150%.

Rare Earth Metal: 0 to 0.200%

Rare earth metal (REM) is an optional element and does not have to be contained. That is, the REM content may be 0%. When contained, REM immobilizes S in the steel material as sulfide to make it harmless, and thus improves the hot-workability of the steel material. If even a small amount of REM is contained, the aforementioned effect can be obtained to some extent. However, if the REM content is too high, the oxide in the steel material becomes coarse, thereby deteriorating the low-temperature toughness of the steel material even if the contents of other elements are within the range of the present embodiment. Therefore, the REM content is 0 to 0.200%. A lower limit of the REM content is preferably more than 0%, more preferably 0.005%, further preferably 0.010%, further preferably 0.020%, and further preferably 0.030%. An upper limit of the REM content is preferably 0.180%, and more preferably 0.150%.

Note that REM in this description means Scandium (Sc) of atomic number 21, Yttrium (Y) of atomic number 39, and one or more types of element selected from the group consisting of lanthanum (La) of atomic number 57 to lutetium (Lu) of atomic number 71, which are called lanthanoids. Moreover, the REM content in the present description means the total content of these elements.

[Microstructure]

The microstructure of a duplex stainless seamless steel pipe according to the present embodiment consists of ferrite and austenite. As used herein, "consists of ferrite and austenite" means that the amount of any phase other than ferrite and austenite is negligibly small. For example, in the chemical composition of the duplex stainless seamless steel pipe according to the present embodiment, volume ratios of precipitates and inclusions are negligibly small as compared with volume ratios of ferrite and austenite. That is, the microstructure of the duplex stainless according to the present embodiment may contain minute amounts of precipitates, inclusions, etc., in addition to ferrite and austenite.

Further, in the microstructure of the duplex stainless seamless steel pipe according to the present embodiment, the volume ratio of ferrite is 30.0 to 70.0%. If the volume ratio of ferrite is too low, the strength and/or corrosion resistance of the steel material may deteriorate. On the other hand, if the volume ratio of ferrite is too high, the low-temperature toughness of the steel material deteriorates. Further, if the volume ratio of ferrite is too high, the hot workability of the steel material may deteriorate. Therefore, in the microstructure of the duplex stainless seamless steel pipe according to the present embodiment, the volume ratio of ferrite is 30.0 to 70.0%. A lower limit of the volume ratio of ferrite is preferably 31.0%, and more preferably 32.0%. An upper limit of the volume ratio of ferrite is preferably 68.0%, and more preferably 65.0%.

In the present embodiment, the volume ratio of ferrite in the duplex stainless seamless steel pipe can be determined by the following method. A test specimen for microstructure observation is prepared from the center portion of wall thickness of the duplex stainless seamless steel pipe according to the present embodiment. The microstructure observation is carried out on the observation surface including a pipe axis direction (L direction) and a pipe radius direction (T direction) in the center portion of wall thickness of the duplex stainless seamless steel pipe.

The size of the test specimen for the microstructure observation is not particularly limited, and it is sufficient if an observation surface of 5 mm (L direction)×5 mm (T direction) can be obtained. The test specimen is prepared such that a center position of the observation surface in the T direction substantially coincides with the center portion of wall thickness of the duplex stainless seamless steel pipe. The observation surface of the prepared test specimen is mirror-polished. The mirror-polished observation surface is electrolytically etched in a 7% potassium hydroxide etching solution to reveal the microstructure. The observation surface on which the microstructure has been revealed is observed in 10 fields of view using an optical microscope. The area of the observation field of view region is not particularly limited, but is, for example, 1.00 $mm^2$ (at a magnification of 100 times).

In each field of view, ferrite and austenite are identified from contrast. Area ratios of the identified ferrite and austenite are determined. The method for obtaining the area ratios of ferrite and austenite is not particularly limited, and a well-known method may be used. For example, they can be determined by image analysis. In the present embodiment, an arithmetic average value of the area ratios of ferrite determined in all fields of view is defined as the volume ratio (%) of ferrite.

As described above, the duplex stainless seamless steel pipe according to the present embodiment may contain precipitates, inclusions, etc., in addition to ferrite and austenite in the microstructure. However, as described above, the volume ratios of precipitates, inclusions, etc., are negligibly small as compared with the volume ratios of ferrite and austenite. Therefore, in the present description, when a total volume ratio of ferrite and austenite is calculated by the above-described method, the volume ratios of precipitates, inclusions, etc., will be ignored.

[Layered Structure]

The microstructure of the duplex stainless seamless steel pipe of the present embodiment further has a layered structure of ferrite and austenite, as shown in FIG. 2. The layered structure in the microstructure of the duplex stainless seamless steel pipe according to the present embodiment can be observed by the following method.

Similarly to the method for determining the volume ratio of ferrite described above, a test specimen for microstructure observation, which has an observation surface including a pipe axis direction (L direction) and a pipe radius direction (T direction), is prepared from the center portion of wall thickness of the duplex stainless. As described above, the test specimen is prepared such that the test specimen has an observation surface of 5 mm (L direction)×5 mm (T direction) and a center position of the observation surface in the T direction substantially coincides with the center portion of wall thickness of the duplex stainless seamless steel pipe. The observation surface of the prepared test specimen is mirror-polished. The mirror-polished observation surface is electrolytically etched in a 7% potassium hydroxide etching solution to reveal the microstructure. The observation surface in which the microstructure is revealed is observed in 10 fields of view using an optical microscope. The area of the observation field of view region is 1.0 mm×1.0 mm=1.00 $mm^2$ (a magnification of 100 times).

FIG. 3 is a schematic diagram to illustrate a method for calculating a layer index (LI) in the present embodiment. FIG. 3 shows a schematic diagram of the microstructure of a cross section which is located at a center portion of wall thickness of the duplex stainless seamless steel pipe of the present embodiment, and which includes the L direction and the T direction. Referring to FIG. 3, in the cross section including the L direction and the T direction at the center portion of wall thickness of the duplex stainless seamless steel pipe, a square region whose side extending in the L direction is 1.0 mm long, and whose side extending in the T direction is 1.0 mm long is an observation field of view region 50. In FIG. 3, the observation field of view region 50 includes the ferrite 10 (a white region in the figure) and the austenite 20 (a hatched region in the figure). In an actual observation field of view region 50 which has been etched, as described above, those skilled in the art can discriminate between ferrite and austenite by contrast.

In the observation field of view region 50, as shown in FIG. 3, line segments extending in the T direction, arranged at equal intervals in the L direction of the observation field of view region 50, and dividing the observation field of view region 50 into five equal parts in the L direction (pipe axis direction) are defined as line segments T1 to T4. Then, the number of intersections (marked with "●" in FIG. 3) between the line segments T1 to T4 and the ferrite interface in the observation field of view region 50 is defined as the number of intersections NT (pieces).

Further, line segments extending in the L direction, arranged at equal intervals in the T direction of the observation field of view region 50, and dividing the observation field of view region 50 into five equal parts in the T direction (pipe radius direction) are defined as line segments L1 to L4. Then, the number of intersections (marked with "0" in FIG. 3) between the line segments L1 to L4 and the ferrite interface in the observation field of view region 50 is defined as the number of intersections NL (pieces).

The microstructure of the duplex stainless seamless steel pipe according to the present embodiment has a layered structure that satisfies that the number of intersections NT is 40.0 or more and the layer index LI defined by Formula (1) is 2.0 or more, in the above-described observation field of view region 50.

$$\text{Layer index (LI)} = NT/NL \quad (1)$$

The layer index LI means a degree of development of the layered structure. In the duplex stainless seamless steel pipe which has the above-described chemical composition and in which the volume ratio of ferrite is 30.0 to 70.0%, when the layer index LI is 2.0 or more, a fully developed layered structure has been obtained. In this case, the duplex stainless seamless steel pipe exhibits excellent low-temperature toughness. More specifically, for example, when the duplex stainless seamless steel pipe of the present embodiment is applied to an oil well application, cracks are likely to propagate in the pipe radius direction. When the duplex stainless seamless steel pipe of the present embodiment has a layered structure in which the number of intersections NT is 40.0 or more, and the layer index LI is 2.0 or more in the center portion of wall thickness, even if a fine crack is generated and the crack propagates in the ferrite in the pipe radius direction, austenite stops the propagation of the crack when the crack reaches the interface between the ferrite and the austenite. Therefore, the duplex stainless seamless steel pipe according to the present embodiment has excellent low-temperature toughness.

A lower limit of the number of intersections NT in the T direction is preferably 45.0, more preferably 50.0, and further preferably 60.0. An upper limit of the number of intersections NT is not particularly limited, but is, for example, 150.0. A lower limit of the layer index LI is preferably 2.1, more preferably 2.2, further preferably 2.4, further preferably 2.5, and further preferably 2.7. An upper limit of the layer index is not particularly limited, but is, for example, 10.0.

In the present description, the number of intersections NT of the duplex stainless seamless steel pipe of the present embodiment means an average value of the number of intersections NT obtained in each of arbitrary 10 observation field of view regions in the observation surface of the test specimen taken by the above-described method. Moreover, the layer index LI of the duplex stainless seamless steel pipe of the present embodiment means an average value of the layer index LI obtained in each of arbitrary 10 observation field of view regions in the observation surface of the test specimen taken by the above-described method.

[Yield Strength]

The yield strength of the duplex stainless seamless steel pipe according to the present embodiment is not particularly limited. However, if the yield strength becomes more than 655 MPa, the low-temperature toughness of the steel material may deteriorate. Therefore, the yield strength of the duplex stainless seamless steel pipe according to the present embodiment is preferably 655 MPa or less. The lower limit of the yield strength is not particularly limited, but is, for example, 448 MPa.

In short, in the duplex stainless seamless steel pipe according to the present embodiment, which has the above-described chemical composition, and in which the volume ratio of ferrite is 30.0 to 70.0%, the number of intersections NT in the T direction is 40.0 or more, and the layer index LI is 2.0 or more, the yield strength is, for example, 448 to 655 MPa (65 to 95 ksi). A lower limit of the yield strength is preferably 450 MPa, and more preferably 460 MPa. An upper limit of the yield strength is more preferably 650 MPa, and further preferably 640 MPa.

The yield strength of the duplex stainless seamless steel pipe according to the present embodiment can be determined by the following method. Specifically, a tensile test is performed by a method conforming to ASTM E8/E8M (2013). A round bar test specimen is prepared from the center portion of wall thickness of the seamless steel pipe according to the present embodiment. The size of the round bar test specimen is, for example, as follows: a parallel portion diameter is 8.9 mm and a parallel portion length is 35.6 mm. Note that the axial direction of the round bar test specimen is in parallel with the pipe axis direction of the seamless steel pipe. A tensile test is carried out in the atmosphere at room temperature (25° C.) by using the prepared round bar test specimen. The 0.2% offset proof stress obtained by the tensile test carried out under the above conditions is defined as the yield strength (MPa). Further, the maximum stress during uniform elongation obtained in the tensile test is defined as the tensile strength (MPa).

[Low-Temperature Toughness]

The duplex stainless seamless steel pipe according to the present embodiment has excellent low-temperature toughness as a result of having the above-described chemical composition and the above-described microstructure. In the present embodiment, excellent low-temperature toughness is defined as follows.

Specifically, a Charpy impact test conforming to ASTM E23 (2018) is carried out on the duplex stainless seamless steel pipe according to the present embodiment to evaluate low-temperature toughness. First, a V-notch test specimen is prepared from a center portion of wall thickness of the seamless steel pipe according to the present embodiment. Specifically, the V-notch test specimen is prepared conforming to API 5CRA (2010). A Charpy impact test conforming to ASTM E23 (2018) is carried out on a V-notch test specimen prepared conforming to API 5CRA (2010) to determine absorbed energy E (J) at −10° C. and energy transition temperature vTE (° C.). In the present embodiment, when the absorbed energy E at −10° C. is 120 J or more and the energy transition temperature vTE is −18.0° C. or less, it is judged that the test specimen has excellent low-temperature toughness. In the present embodiment, a lower limit of the absorbed energy E at −10° C. is preferably 125 J, and more preferably 130 J. In the present embodiment, an upper limit of the energy transition temperature vTE is more preferably −18.5° C., and further preferably −19.0° C.

[Production Method]

An example of a method for producing a duplex stainless seamless steel pipe according to the present embodiment, which has the above-described configuration, will be described. Note that the method for producing a duplex stainless seamless steel pipe according to the present embodiment is not limited to the production method described below. An example of the method for producing a duplex stainless seamless steel pipe according to the present embodiment includes a starting material preparation step, a hot working step, and a solution heat treatment step. Hereinafter, each production step will be described in detail.

[Starting Material Preparation Step]

In the starting material preparation step, a starting material having the above-described chemical composition is prepared. The starting material may be prepared by producing it, or may be prepared by purchasing it from a third party. That is, the method for preparing the starting material is not particularly limited. Note that it is preferable that the starting material is a billet having a circular cross section (that is, a round billet) in order to carry out piercing-rolling described later. When the starting material is a round billet, the size of the round billet is not particularly limited.

When the starting material is produced, the production is performed by, for example, the following method. A molten steel having the above-described chemical composition is produced. By using the molten steel, a cast piece (a slab, a bloom, or a billet) is produced by a continuous casting method. A steel ingot may be produced by an ingot-making method by using the molten steel. If desired, a slab, a bloom or an ingot may be subjected to blooming to produce a billet. The starting material is produced by the step described above.

[Hot Working Step]

In the hot working step, an empty hollow shell (seamless steel pipe) is produced from a starting material having the above-described chemical composition by hot working. In the present embodiment, the hot working step includes a heating step, a piercing-rolling step, and an elongating-rolling step. Hereinafter, each step will be described in detail.

[Heating Step]

In the heating step, the starting material prepared by the above-described starting material preparation step is heated at a heating temperature $T_A$° C. of 1000 to 1280° C. The heating method is, for example, a method of charging the starting material into a heating furnace and heating it. At this time, the heating temperature $T_A$ in the heating step corresponds to a furnace temperature (° C.) of the heating furnace for heating the starting material. In the heating step, the time for holding the prepared starting material at $T_A$° C. (heating time) is not particularly limited, but is, for example, 1.0 to 10.0 hours.

When the heating temperature $T_A$ is too high, ferrite and/or austenite may become coarse in the microstructure. In this case, the number of intersections NT in the T direction may be less than 40.0. In this case, the layer index LI may further become less than 2.0. As a result, the low-temperature toughness of the duplex stainless seamless steel pipe deteriorates.

On the other hand, when the heating temperature $T_A$ is too low, the hot workability will deteriorate. As a result, surface flaws are likely to occur in the duplex stainless seamless steel pipe. Therefore, in the heating step according to the present embodiment, the heating temperature $T_A$ is 1000 to 1280° C. In the heating step according to the present embodiment, a lower limit of the heating temperature $T_A$ is preferably 1050° C., and more preferably 1100° C. In the heating step according to the present embodiment, an upper limit of the heating temperature $T_A$ is preferably 1250° C., and more preferably 1200° C.

[Piercing-Rolling Step]

In the piercing-rolling step, the starting material heated by the above-described heating step is piercing-rolled at an area reduction ratio $R_A$% which satisfies Formula (A):

$$R_A \geq -0.000200 \times T_A^2 + 0.513 \times T_A - 297 \quad \text{(A)}$$

Where, $R_A$ in Formula (A) is defined by Formula (B).

$$R_A = \{1 - (\text{cross-sectional area perpendicular to pipe axis direction of hollow shell after piercing-rolling/cross-sectional area perpendicular to axial direction of the starting material before piercing-rolling})\} \times 100 \quad \text{(B)}$$

Piercing-rolling produces an empty hollow shell from a solid starting material using a piercing machine. The piercing machine includes a pair of skew rolls and a plug. The pair of skew rolls are arranged around a pass line. The plug is located between the pair of skew rolls and disposed on the path line. Here, in the present description, the pass line means a line through which the central axis of the starting material passes at the time of piercing-rolling. The skew roll is not particularly limited, and may be a barrel type, a cone type, or a disc type.

The "hollow shell after piercing-rolling" in Formula (B) means a hollow shell after piercing-rolling is completed. The "starting material before piercing-rolling" in Formula (B) means a starting material before piercing-rolling is performed. In this way, in the present embodiment, the area reduction ratio $R_A$ % means an area reduction ratio when the starting material is formed into a hollow shell by piercing-rolling. As will be described later, in the present embodiment, elongating-rolling is performed as hot rolling in addition to piercing-rolling. However, elongating-rolling hardly contributes to the machining strain in the center portion of wall thickness of the hollow shell. Therefore, in the present embodiment, the area reduction ratio $R_A$ % is defined by using the cross-sectional area that changes due to piercing-rolling.

Definition is made as $Fn1 = -0.000200 \times T_A^2 + 0.513 \times T_A - 297$. To obtain the layered structure in which the number of intersections NT in the T direction is 40.0 or more and the layer index LI is 2.0 or more in the center portion of wall thickness of the duplex stainless seamless steel pipe having the above described chemical composition, relationship between the heating temperature $T_A$ (C) in the above-described heating step and the area reduction ratio $R_A$ (%) in the piercing-rolling step is important. In the piercing-rolling step, by performing the piercing-rolling at an appropriate area reduction ratio of Fn1 or more, sufficient machining strain can be obtained even in the center portion of wall thickness of the seamless steel pipe. As a result, in the duplex stainless seamless steel pipe after the solution heat treatment step to be described later, a microstructure in which the number of intersections NT in the T direction is 40.0 or more, and the layer index LI is 2.0 or more is obtained in the center portion of wall thickness.

Therefore, in the piercing-rolling step according to the present embodiment, the area reduction ratio $R_A$ due to the piercing-rolling is Fn1 or more. When the area reduction ratio $R_A$ is Fn1 or more, the layered structure will be sufficiently developed in the produced duplex stainless seamless steel pipe based on the premise that the above-described chemical composition and the conditions of each step to be described later are satisfied. As a result, the layered structure in which the number of intersections NT in the T direction is 40.0 or more and the layer index LI is 2.0 or more can be obtained. Note that the upper limit of the area reduction ratio $R_A$ is not particularly limited, but is, for example, 80%.

[Elongating-Rolling Step]

In the elongating-rolling step, the hollow shell produced by the above-described piercing-rolling step is subjected to elongating-rolling. Elongating-rolling may be performed by a well-known method and is not particularly limited. The elongating-rolling may be performed by a mandrel mill method or a plug mill method. When elongating-rolling is performed by the mandrel mill method, for example, the piercing-rolled hollow shell is subjected to the hot rolling by the mandrel mill. When elongating-rolling is performed by the plug mill method, for example, the piercing-rolled hollow shell is subjected to hot rolling by an elongator mill, and subsequently to hot rolling by a plug mill. Further, the elongating-rolling may use an Assel mill, a Pilger mill, or a Disher mill. As described above, in the elongating-rolling step according to the present embodiment, a well-known method can be used for elongating-rolling.

Specifically, when elongating-rolling is performed by the mandrel mill method, it is performed in the following method. A mandrel bar is inserted into a hollow portion of the piercing-rolled hollow shell. The hollow shell into which the mandrel bar is inserted is advanced on the pass line of the mandrel mill to perform hot rolling. The mandrel bar is pulled out from the hollow shell which has been hot-rolled by the mandrel mill.

The area reduction ratio of the hollow shell in the elongating-rolling step of the present embodiment is not particularly limited. As described above, elongating-rolling in the elongating-rolling step does not contribute so much to the machining strain of the center portion of wall thickness of the hollow shell. Therefore, the area reduction ratio in the elongating-rolling step is different from the area reduction ratio $R_A$ in the piercing-rolling step described above in the degree of effect thereof. The area reduction ratio in the elongating-rolling step is, for example, 10 to 70%.

The hot working step is carried out by the method described above. Note that the hot working step may include steps other than the heating step, the piercing-rolling step, and the elongating-rolling step. For example, diameter adjusting rolling may be performed on the elongating-rolled hollow shell. In this case, the outer diameter of the hollow shell is adjusted by a well-known diameter adjusting rolling mill. The diameter adjusting rolling mill is, for example, a sizer and a stretch reducer.

Further, in the hot working step, in addition to the above-described hot rolling (piercing-rolling, elongating-rolling, and diameter adjusting rolling), hot forging may be performed. For example, hot forging may be performed on the heated starting material to form it into a desired shape, and thereafter piercing-rolling may be performed. In this case, hot forging is performed by using a well-known hot forging machine to adjust the dimensions of the starting material.

[Solution Heat Treatment Step]

In the solution heat treatment step, the hollow shell after the elongating-rolling step is held at 950 to 1080° C. for 5 to 180 minutes. In the present description, the temperature at which the solution heat treatment is performed (heat treatment temperature) means a furnace temperature (° C.) of the heat treatment furnace for performing the solution heat treatment. In the present description, the time for performing the solution heat treatment (heat treatment time) means a time for which the hollow shell is held at the heat treatment temperature (° C.).

When the heat treatment temperature is too low, precipitates will remain in the duplex stainless seamless steel pipe after the solution heat treatment step. In this case, the low-temperature toughness of the duplex stainless seamless steel pipe deteriorates. On the other hand, when the heat treatment temperature is too high, the volume ratio of ferrite increases and becomes more than 70.0%. In this case, the low-temperature toughness of the duplex stainless seamless steel pipe deteriorates. Therefore, in the solution heat treatment step according to the present embodiment, the heat treatment temperature is 950 to 1080° C. A lower limit of the heat treatment temperature is preferably 960° C. An upper limit of the heat treatment temperature is preferably 1070° C.

When the heat treatment time is too short, precipitates will remain in the duplex stainless seamless steel pipe after the solution heat treatment step. In this case, the low-temperature toughness of the duplex stainless seamless steel pipe deteriorates. On the other hand, when the heat treatment time is too long, the effect of dissolving precipitates is saturated. Therefore, in the solution heat treatment step according to the present embodiment, the heat treatment time is 5 to 180 minutes. Note that the solution heat treatment may be performed on the starting material which has been once cooled to room temperature after hot working. Moreover, the solution heat treatment may be performed continuously on the starting material after hot working.

According to the production method described above, the duplex stainless seamless steel pipe according to the present embodiment can be produced. The duplex stainless seamless steel pipe produced by the above-described production method has the microstructure in which the volume ratio of ferrite is 30.0 to 70.0%, the number of intersections NT in the T direction is 40.0 or more, and further the layer index LI is 2.0 or more, at the center portion of wall thickness. Therefore, the duplex stainless seamless steel pipe produced by the above-described production method has excellent low-temperature toughness.

The above-described method for producing a duplex stainless seamless steel pipe is an example for producing a duplex stainless seamless steel pipe according to the present embodiment. That is, the duplex stainless seamless steel pipe according to the present embodiment may be produced by a production method other than the above-described production method. In short, the duplex stainless seamless steel pipe may be produced by a production method other than the above-described production method as long as it has the microstructure in which the volume ratio of ferrite is 30.0 to 70.0%, the number of intersections NT in the T direction is 40.0 or more, and further the layer index LI is 2.0 or more, in the center portion of wall thickness of the seamless steel pipe.

Examples

Molten steels having the chemical compositions shown in Table 2 were melted using a 50 kg vacuum melting furnace, and ingots were produced by an ingot casting method. Note that the symbol "-" in Table 2 means that the content of the corresponding element was at an impurity level.

TABLE 2

| Steel | Chemical composition (in mass %, the balance being Fe and impurities) | | | | | | | | | | |
|---|---|---|---|---|---|---|---|---|---|---|---|
| | C | Si | Mn | P | S | Cu | Cr | Ni | Mo | Al | N |
| A | 0.017 | 0.54 | 0.98 | 0.021 | 0.0005 | 2.48 | 25.18 | 5.05 | 1.08 | 0.017 | 0.188 |
| B | 0.020 | 0.42 | 1.82 | 0.031 | 0.0082 | 3.51 | 26.39 | 4.33 | 0.82 | 0.028 | 0.256 |
| C | 0.018 | 0.64 | 2.45 | 0.025 | 0.0012 | 2.11 | 24.11 | 4.91 | 1.28 | 0.022 | 0.243 |
| D | 0.024 | 0.52 | 6.11 | 0.019 | 0.0009 | 1.92 | 25.88 | 7.82 | 1.66 | 0.019 | 0.197 |
| E | 0.020 | 0.83 | 4.98 | 0.016 | 0.0028 | 3.38 | 27.31 | 6.66 | 0.61 | 0.031 | 0.157 |
| F | 0.017 | 0.72 | 5.22 | 0.022 | 0.0017 | 3.46 | 20.87 | 5.91 | 0.98 | 0.032 | 0.176 |
| G | 0.015 | 0.26 | 3.55 | 0.012 | 0.0061 | 2.66 | 22.66 | 4.80 | 1.22 | 0.028 | 0.342 |
| H | 0.013 | 0.58 | 0.67 | 0.034 | 0.0059 | 1.99 | 23.73 | 7.21 | 1.47 | 0.019 | 0.281 |
| I | 0.022 | 0.45 | 1.93 | 0.036 | 0.0035 | 2.53 | 25.94 | 6.22 | 1.11 | 0.015 | 0.192 |
| J | 0.020 | 0.68 | 3.24 | 0.027 | 0.0042 | 2.91 | 27.10 | 5.99 | 1.82 | 0.017 | 0.271 |
| K | 0.016 | 0.39 | 2.54 | 0.019 | 0.0027 | 3.13 | 27.11 | 4.51 | 1.54 | 0.027 | 0.175 |
| L | 0.027 | 0.47 | 0.88 | 0.015 | 0.0011 | 2.97 | 24.66 | 5.85 | 1.07 | 0.034 | 0.293 |
| M | 0.012 | 0.82 | 1.91 | 0.038 | 0.0009 | 1.87 | 25.80 | 7.94 | 0.82 | 0.025 | 0.341 |
| N | 0.013 | 0.66 | 4.82 | 0.027 | 0.0097 | 3.88 | 24.99 | 6.82 | 0.93 | 0.017 | 0.199 |
| O | 0.017 | 0.37 | 1.33 | 0.025 | 0.0041 | 2.25 | 26.10 | 5.38 | 1.92 | 0.018 | 0.281 |

| Steel | Chemical composition (in mass %, the balance being Fe and impurities) | | | | | | | | | |
|---|---|---|---|---|---|---|---|---|---|---|
| | V | Nb | Ta | Ti | Zr | Hf | Ca | Mg | B | REM |
| A | — | — | — | — | — | — | — | — | — | — |
| B | 0.10 | — | — | — | — | — | — | — | — | — |
| C | — | 0.004 | — | — | — | — | — | — | — | — |
| D | — | — | 0.005 | — | — | — | — | — | — | — |
| E | — | — | — | 0.002 | — | — | — | — | — | — |
| F | — | — | — | — | 0.008 | — | — | — | — | — |
| G | — | — | — | — | — | 0.011 | — | — | — | — |
| H | — | — | — | — | — | — | 0.0017 | — | — | — |
| I | — | — | — | — | — | — | — | 0.0021 | — | — |
| J | — | — | — | — | — | — | — | — | 0.0105 | — |
| K | — | — | — | — | — | — | — | — | — | 0.058 |
| L | 0.20 | 0.002 | — | — | — | — | 0.0015 | — | — | — |
| M | — | 0.004 | — | 0.003 | — | — | 0.0012 | 0.0030 | — | — |
| N | 0.20 | — | 0.050 | — | — | — | — | — | 0.0152 | 0.046 |
| O | 0.20 | 0.004 | — | 0.003 | — | — | 0.0014 | 0.0053 | — | 0.041 |

Each ingot obtained was subjected to hot forging to produce a billet with a circular cross section (round billet). The round billet of each Test Number was heated at a heating temperature $T_A$ (° C.) shown in Table 3 for 180 minutes. In the present embodiment, the heating temperature $T_A$ (° C.) corresponded to the furnace temperature (° C.) of the heating furnace used for heating. Table 3 shows Fn1 obtained from the heating temperature $T_A$ (° C.) and Formula (A). The round billet of each Test Number after heating was subjected to piercing-rolling at an area reduction ratio $R_A$ (%) shown in Table 3, and thereafter subjected to elongating-rolling to produce a hollow shell having a shape as shown in Table 3.

TABLE 3

| Test Number | Steel | Shape | $T_A$ (° C.) | Fn1 | $R_A$ (%) | Heat treatment temperature (° C.) | Ferrite volume ratio (%) | NT (pieces) | NL (pieces) | LI | YS (MPa) | TS (MPa) | E (J) | vTE (° C.) |
|---|---|---|---|---|---|---|---|---|---|---|---|---|---|---|
| 1 | A | E | 1280 | 32 | 58 | 980 | 52.0 | 43.8 | 12.9 | 3.4 | 567 | 808 | 254 | −40.8 |
| 2 | B | A | 1000 | 16 | 45 | 980 | 50.1 | 76.1 | 17.3 | 4.3 | 587 | 807 | 180 | −62.2 |
| 3 | C | A | 1000 | 16 | 68 | 980 | 42.5 | 109.5 | 22.3 | 4.9 | 517 | 788 | 248 | −68.2 |
| 4 | D | D | 1100 | 25 | 44 | 980 | 48.8 | 48.8 | 11.2 | 4.3 | 566 | 776 | 245 | −33.4 |
| 5 | E | D | 1100 | 25 | 67 | 980 | 52.5 | 119.0 | 24.6 | 4.8 | 512 | 786 | 310 | −65.7 |
| 6 | F | E | 1200 | 31 | 44 | 980 | 33.1 | 48.4 | 10.7 | 4.5 | 567 | 787 | 210 | −35.3 |
| 7 | G | E | 1200 | 31 | 67 | 980 | 39.1 | 73.2 | 15.8 | 4.6 | 518 | 777 | 294 | −69.3 |
| 8 | H | E | 1280 | 32 | 47 | 980 | 47.4 | 41.2 | 15.7 | 2.7 | 530 | 762 | 194 | −25.7 |
| 9 | I | A | 1280 | 32 | 68 | 980 | 41.6 | 48.2 | 11.8 | 4.1 | 552 | 796 | 281 | −45.9 |
| 10 | J | A | 1280 | 32 | 68 | 980 | 56.2 | 51.3 | 11.9 | 4.3 | 567 | 802 | 178 | −59.4 |
| 11 | K | B | 1280 | 32 | 48 | 980 | 59.3 | 42.0 | 14.5 | 2.9 | 545 | 793 | 189 | −23.9 |
| 12 | L | C | 1280 | 32 | 56 | 980 | 35.6 | 43.5 | 11.8 | 3.7 | 567 | 806 | 262 | −52.0 |
| 13 | M | D | 1280 | 32 | 66 | 980 | 45.0 | 51.0 | 12.1 | 4.2 | 541 | 794 | 285 | −58.0 |
| 14 | N | E | 1280 | 32 | 66 | 980 | 63.7 | 54.2 | 12.6 | 4.3 | 553 | 801 | 284 | −56.5 |
| 15 | O | E | 1280 | 32 | 59 | 980 | 53.8 | 44.8 | 12.8 | 3.5 | 545 | 798 | 260 | −42.5 |
| 16 | A | E | 1280 | 32 | 33 | 980 | 54.3 | 46.3 | 21.7 | 2.1 | 567 | 810 | 140 | −19.6 |
| 17 | A | E | 1280 | 32 | 28 | 980 | 50.2 | 40.5 | 21.1 | 1.9 | 558 | 801 | 98 | −13.4 |
| 18 | B | A | 1200 | 31 | 21 | 980 | 53.0 | 35.8 | 19.1 | 1.9 | 551 | 773 | 96 | −11.6 |
| 19 | A | E | 1280 | 32 | 23 | 980 | 57.5 | 33.5 | 19.1 | 1.8 | 552 | 801 | 94 | −8.1 |
| 20 | C | A | 1280 | 32 | 26 | 980 | 44.3 | 36.2 | 20.1 | 1.8 | 569 | 817 | 92 | −8.3 |
| 21 | A | E | 1280 | 32 | 69 | 1100 | 77.1 | 46.8 | 12.8 | 3.7 | 572 | 808 | 111 | −17.7 |

Note that "A" in the "Shape" column of Table 3 means a seamless steel pipe shape having an outer diameter of 114.3 mm and a wall thickness of 7.3 mm. "B" in the "Shape" column of Table 3 means a seamless steel pipe shape having an outer diameter of 159 mm and a wall thickness of 22.12 mm. "C" in the "Shape" column of Table 3 means a seamless steel pipe shape having an outer diameter of 130 mm and a wall thickness of 17.76 mm. "D" in the "Shape" column of Table 3 means a seamless steel pipe shape having an outer diameter of 139.7 mm and a wall thickness of 9.17 mm. "E" in the "Shape" column of Table 3 means a seamless steel pipe shape having an outer diameter of 177.8 mm and a wall thickness of 10.36 mm.

The hollow shell of each Test Number, which had been processed into a shape shown in Table 3 by the piercing-rolling and the elongating-rolling, was subjected to the solution heat treatment. The heat treatment temperature (° C.) of the solution heat treatment for the hollow shell of each Test Number was as shown in Table 3. The heat treatment time of the solution heat treatment for the hollow shell of each Test Number was 15 minutes. Note that the heat treatment temperature corresponded to the furnace temperature (° C.) of the heat treatment furnace used for the solution heat treatment. The heat treatment time corresponded to the time for which the hollow shell was held at the heat treatment temperature. Through the steps described above, seamless steel pipes of each Test Number were obtained.

[Evaluation Test]

The seamless steel pipes of each Test Number that had been subjected to the solution heat treatment were subjected to a microstructure observation, a tensile test, and a Charpy impact test.

[Microstructure Observation]

Microstructure observation was performed on the seamless steel pipes of each Test Number. Specifically, a test specimen for microstructure observation was prepared from the center portion of wall thickness of the seamless steel pipe of each Test Number. The test specimen included an observation surface of 5 mm in the pipe axis direction (L direction) and 5 mm in the pipe radius direction (T direction) of the seamless steel pipe of each Test Number, and a central portion of the observation surface substantially coincided with the center portion of wall thickness of the seamless steel pipe. The observation surface of the test specimen of each Test Number was polished into a mirror surface. The mirror-polished observation surface was electrolytically etched in a 7% potassium hydroxide etching solution to reveal the microstructure. The observation surface on which the microstructure had been revealed was observed in 10 fields of view using an optical microscope. The area of each field of view was 1.00 $mm^2$ (1.0 mm×1.0 mm), and the magnification was 200 times.

Ferrite and austenite were identified based on contrast in each field of view of each Test Number. As a result, in each field of view of each Test Number, phases other than ferrite and austenite in the microstructure were negligibly small in amount. That is, the seamless steel pipe of each Test Number had a microstructure composed of ferrite and austenite. The area ratio of the identified ferrite in each field of view of each Test Number was determined by image analysis. An arithmetic average value of area ratios of ferrite in 10 fields of view was taken as the ferrite volume ratio (%). Table 3 shows the ferrite volume ratios (%) determined for the seamless steel pipes of each Test Number.

In each field of view of each Test Number, line segments T1 to T4 extending in the T direction were further arranged at equal intervals in the L direction of each field of view to divide each field of view into five equal parts in the L direction. In each field of view of each Test Number, line segments L1 to L4 extending in the L direction were further arranged at equal intervals in the T direction of each field of view to divide each field of view into five equal parts in the T direction. The number of intersections between the line segments T1 to T4 and the ferrite interface was counted, and was defined as the number of intersections NT (pieces) in the T direction. Similarly, the number of intersections between the line segments LI to L4 and the ferrite interface was counted to obtain the number of intersections NL (pieces) in the L direction. The layer index LI (=NT/NL) was obtained by using the obtained number of intersections NT in the T direction and the number of intersections NL in the L direction.

An arithmetic average value of the number of intersections NT in the T direction in 10 fields of view was defined as the number of intersections NT (pieces) in the T direction in the seamless steel pipe of that Test Number. Similarly, the arithmetic mean value of the number of intersections NL in the L direction in 10 fields of view was defined as the number of intersections NL (pieces) in the L direction in the seamless steel pipe of that Test Number. Similarly, the arithmetic mean value of the layer index LI in 10 fields of view was taken as the layer index LI in the seamless steel pipe of that Test Number. For seamless steel pipes of each Test Number, Table 3 shows the number of intersections NT (pieces) in the T direction as "NT (pieces)", the number of intersections NL (pieces) in the L direction as "NL (pieces)", and the layer index LI as "LI", respectively.

[Tensile Test]

A tensile test was carried out on the seamless steel pipe of each Test Number by the above-described method conforming to ASTM E8/E8M (2013) to determine yield strength (MPa). In the present Example, the round bar test specimen for the tensile test was prepared from the center portion of wall thickness of the seamless steel pipe of each Test Number. The axial direction of the round bar test specimen was parallel to the pipe axis direction of the seamless steel pipe. The 0.2% offset proof stress obtained in the tensile test was defined as the yield strength (MPa). Further, the maximum stress during uniform elongation obtained in the tensile test was defined as the tensile strength (MPa). Table 3 shows the yield strength (MPa) of the seamless steel pipe of each Test Number as "YS (MPa)" and the tensile strength (MPa) as "TS (MPa)." The yield strength of the seamless steel pipe of each Test Number was in a range of 448 to 655 MPa.

[Charpy Impact Test]

A Charpy impact test conforming to ASTM E23 (2018) was carried out on the duplex stainless seamless steel pipes of each Test Number. Specifically, a V-notch test specimen was prepared from the center portion of wall thickness of the seamless steel pipe of each Test Number conforming to API 5CRA (2010). The Charpy impact test was carried out conforming to ASTM E23 (2016) on the V-notch test specimens of each Test Number prepared conforming to API 5CRA (2010) to determine absorbed energy E (J).

More specifically, three test specimens of each Test Number prepared conforming to API 5CRA (2010) were cooled to −10° C., and a Charpy impact test conforming to ASTM E23 (2016) was carried out. The absorbed energy of the test specimen of each Test Number at −10° C. was determined. An arithmetic average value of the absorbed energy at −10° C. was taken as the absorbed energy E (J) of each Test Number. For the seamless steel pipe of each Test Number, absorbed energy E (J) is shown as "E (J)" in Table 3.

The Charpy impact test was further performed conforming to ASTM E23 (2016) on the V-notch test specimens of each Test Number prepared conforming to API 5CRA (2010) to determine energy transition temperature (° C.). More specifically, for the test specimens of each Test Number prepared conforming to API 5CRA (2010), the Charpy impact test conforming to ASTM E23 (2016) was carried out at intervals of 20° C. from −10 to −70° C. to determine the energy transition temperature vTE (° C.) of each Test Number. Table 3 shows the energy transition temperature vTE (° C.) of each Test Number obtained for the seamless steel pipe of each Test Number.

[Test Results]

Table 3 shows test results.

Referring to Tables 2 and 3, the chemical compositions of duplex stainless seamless steel pipes of Test Numbers 1 to 16 were appropriate. Moreover, the production conditions were also appropriate. Therefore, the volume ratios of ferrite were 30.0 to 70.0%. Further, the numbers of the intersections NT were 40.0 or more, and the layer indices LI were 2.0 or more. That is, the seamless steel pipes of Test Numbers 1 to 16 had a fine microstructure with a sufficient layered structure. As a result, the absorbed energy E at −10° C. was 120 J or more, and the energy transition temperature vTE was −18.0° C. or less. That is, the seamless steel pipes of Test Numbers 1 to 16 had excellent low-temperature toughness.

On the other hand, in Test Number 17, the area reduction ratio $R_A$ was less than Fn1. Therefore, the layer index LI was less than 2.0. That is, although the seamless steel pipe of Test Number 17 had a fine microstructure, it did not have a sufficient layered structure. As a result, the absorbed energy E at −10° C. was less than 120 J, and the energy transition temperature vTE was more than −18.0° C. That is, the seamless steel pipe of Test Number 17 did not have excellent low-temperature toughness.

In Test Numbers 18 to 20, the area reduction ratios $R_A$ were less than Fn1. Therefore, the numbers of the intersections NT were less than 40.0, and the layer indices LI were less than 2.0. That is, the seamless steel pipes of Test Numbers 18 to 20 had neither fine microstructure nor sufficient layered structure. As a result, the absorbed energy E at −10° C. was less than 120 J, and the energy transition temperature vTE was more than −18.0° C. That is, the seamless steel pipes of Test Numbers 18 to 20 did not have excellent low-temperature toughness.

In Test Number 21, the heat treatment temperature in the solution heat treatment step was too high. Therefore, the volume ratio of ferrite was more than 70.0%. As a result, the absorbed energy E at −10° C. was less than 120 J, and the energy transition temperature vTE was more than −18.0° C. That is, the seamless steel pipe of Test Number 21 did not have excellent low-temperature toughness.

The embodiment of the present disclosure has been described so far. However, the embodiment described above is merely an example for carrying out the present disclosure. Therefore, the present disclosure is not limited to the above-described embodiment, and can be implemented by appropriately modifying the above-described embodiment within a range not departing from the spirit thereof.

INDUSTRIAL APPLICABILITY

The duplex stainless seamless steel pipe according to the present disclosure can be widely applied to low temperature environments where low-temperature toughness is required. The duplex stainless seamless steel pipe according to the present disclosure is particularly suitable for oil well applications. Duplex stainless seamless steel pipes for oil well applications are, for example, line pipes, casings, tubings and drill pipes.

REFERENCE SIGNS LIST

10 Ferrite
20 Austenite
50 Observation field of view region
T1 to T4, L1 to L4 Line segments

The invention claimed is:

1. A duplex stainless seamless steel pipe comprising:
a chemical composition consisting of, in mass %,
C: 0.030% or less,
Si: 0.20 to 1.00%,
Mn: 0.50 to 7.00%,
P: 0.040% or less,
S: 0.0100% or less,
Cu: 1.80 to 4.00%,
Cr: 20.00 to 28.00%,
Ni: 4.00 to 9.00%,
Mo: 0.50 to 2.00%,
Al: 0.100% or less,
N: 0.150 to 0.350%,
V: 0 to 1.50%,
Nb: 0 to 0.100%,
Ta: 0 to 0.100%,
Ti: 0 to 0.100%,
Zr: 0 to 0.100%,
Hf: 0 to 0.100%,
Ca: 0 to 0.0200%,
Mg: 0 to 0.0200%,
B: 0 to 0.0200%, and
rare earth metal: 0 to 0.200%, with the balance being Fe and impurities, and
a microstructure consisting of 30.0 to 70.0% of ferrite in volume ratio and austenite as the balance,
wherein
when a pipe axis direction of the duplex stainless seamless steel pipe is defined as an L direction and a pipe radius direction of the duplex stainless seamless steel pipe is defined as a T direction,
in a square observation field of view region which includes a center portion of wall thickness of the duplex stainless seamless steel pipe, and whose side extending in the L direction is 1.0 mm long and whose side extending in the T direction is 1.0 mm long,
four line segments, which extend in the T direction, which are arranged at equal intervals in the L direction of the observation field of view region, and which divide the observation field of view region into five equal parts in the L direction, are defined as T1 to T4,
four line segments, which extend in the L direction, which are arranged at equal intervals in the T direction of the observation field of view region, and which divide the observation field of view region into five equal parts in the T direction, are defined as L1 to L4, and
an interface between the ferrite and the austenite in the observation field of view region is defined as a ferrite interface,
a number of intersections NT, which is a number of intersections between the line segments T1 to T4 and the ferrite interface, is 40.0 or more, and a number of intersections NL, which is a number of intersections between the line segments L1 to L4 and the ferrite interface, and the number of intersections NT satisfy Formula (1)

$$NT/NL \geq 2.0 \quad (1).$$

2. The duplex stainless seamless steel pipe according to claim 1, wherein the chemical composition contains one or more types of element selected from the group consisting of:

V: 0.01 to 1.50%,

Nb: 0.001 to 0.100%,

Ta: 0.001 to 0.100%,

Ti: 0.001 to 0.100%,

Zr: 0.001 to 0.100%, and

Hf: 0.001 to 0.100%.

3. The duplex stainless seamless steel pipe according to claim 1, wherein the chemical composition contains one or more types of element selected from the group consisting of:

Ca: 0.0005 to 0.0200%,

Mg: 0.0005 to 0.0200%,

B: 0.0005 to 0.0200%, and rare earth metal: 0.005 to 0.200%.

4. The duplex stainless seamless steel pipe according to claim 2, wherein the chemical composition contains one or more types of element selected from the group consisting of:

Ca: 0.0005 to 0.0200%,

Mg: 0.0005 to 0.0200%,

B: 0.0005 to 0.0200%, and rare earth metal: 0.005 to 0.200%.

5. A method for producing the duplex stainless seamless steel pipe according to claim 1, comprising:

a starting material preparation step for preparing a starting material having the chemical composition consisting of, in mass %, C: 0.030% or less, Si: 0.20 to 1.00%, Mn: 0.50 to 7.00%, P: 0.040% or less, S: 0.0100% or less, Cu: 1.80 to 4.00%, Cr: 20.00 to 28.00%, Ni: 4.00 to 9.00%, Mo: 0.50 to 2.00%, Al: 0.100% or less, N: 0.150 to 0.350%, V: 0 to 1.50%, Nb: 0 to 0.100%, Ta: 0 to 0.100%, Ti: 0 to 0.100%, Zr: 0 to 0.100%, Hf: 0 to 0.100%, Ca: 0 to 0.0200%, Mg: 0 to 0.0200%, B: 0 to 0.0200%, and rare earth metal: 0 to 0.200%, with the balance being Fe and impurities, a heating step for heating the starting material after the starting material preparation step at a heating temperature TA° C. of 1000 to 1280° C., a piercing-rolling step for piercing-rolling the starting material after the heating step at an area reduction ratio RA % satisfying Formula (A) to produce a hollow shell, an elongating-rolling step for elongating and rolling the hollow shell after the piercing-rolling step, and a solution heat treatment step for holding the hollow shell after the elongating-rolling step at 950 to 1080° C. for 5 to 180 minutes:

$$R_A \geq -0.000200 \times T_A^2 + 0.513 \times T_A - 297 \quad (A)$$

where, $R_A$ in Formula (A) is defined by Formula (B)

$$R_A = \{1 - (\text{cross-sectional area perpendicular to pipe axis direction of the hollow shell after piercing-rolling/cross-sectional area perpendicular to axial direction of the starting material before piercing-rolling})\} \times 100 \quad (B).$$

6. The method for producing a duplex stainless seamless steel pipe according to claim 5, wherein the chemical composition of the starting material contains one or more types of element selected from the group consisting of:

V: 0.01 to 1.50%,

Nb: 0.001 to 0.100%,

Ta: 0.001 to 0.100%,

Ti: 0.001 to 0.100%,

Zr: 0.001 to 0.100%, and

Hf: 0.001 to 0.100%.

7. The method for producing a duplex stainless seamless steel pipe according to claim 5, wherein the chemical composition of the starting material contains one or more types of element selected from the group consisting of:

Ca: 0.0005 to 0.0200%,

Mg: 0.0005 to 0.0200%,

B: 0.0005 to 0.0200%, and rare earth metal: 0.005 to 0.200%.

8. The method for producing a duplex stainless seamless steel pipe according to claim 6, wherein the chemical composition of the starting material contains one or more types of element selected from the group consisting of:

Ca: 0.0005 to 0.0200%,

Mg: 0.0005 to 0.0200%,

B: 0.0005 to 0.0200%, and rare earth metal: 0.005 to 0.200%.

* * * * *